US005601376A

United States Patent [19]

Badr et al.

[11] Patent Number: 5,601,376

[45] Date of Patent: Feb. 11, 1997

[54] RETRACTABLE WRITING INSTRUMENT HAVING REPLACEABLE CARTRIDGE

[75] Inventors: Iskandar Badr, Milford, Conn.; Edgar B. Chiswell, Greenville, S.C.

[73] Assignee: BIC Corporation, Milford, Conn.

[21] Appl. No.: 280,066

[22] Filed: Jul. 25, 1994

Related U.S. Application Data

[63] Continuation of Ser. No. 959,166, Oct. 9, 1992, Pat. No. 5,336,006.

[51] Int. Cl.[6] ..... B43K 24/04; B43K 25/00

[52] U.S. Cl. ..... 401/104; 24/11 F; 401/105

[58] Field of Search ..... 401/104, 105, 401/106, 113, 114; 24/11 F, 11 M, 11 P, 11 R

[56] References Cited

U.S. PATENT DOCUMENTS

| | | | |
|---|---|---|---|
| 276,512 | 4/1883 | Webster | 24/11 P |
| D. 321,207 | 10/1991 | Granoff . | |
| 1,147,198 | 7/1915 | Tooker | 24/11 M |
| 1,583,718 | 5/1926 | Hudson . | |
| 1,591,732 | 7/1926 | Atchley | 24/11 P |
| 2,603,187 | 7/1952 | Goos . | |
| 3,033,167 | 5/1962 | Spillman . | |
| 3,092,080 | 6/1963 | Lovejoy . | |
| 3,164,132 | 1/1965 | Ganz . | |
| 3,179,086 | 4/1965 | Owadano . | |
| 3,216,398 | 11/1965 | Washcalus . | |
| 3,224,053 | 12/1965 | Jenkins | 24/11 F |
| 3,326,189 | 6/1967 | Baer . | |
| 3,344,484 | 10/1967 | Zepell et al. . | |
| 3,637,316 | 1/1972 | Bross . | |
| 3,797,945 | 3/1974 | Zepell . | |
| 3,819,282 | 6/1974 | Schultz . | |
| 4,185,933 | 1/1980 | Zepell . | |
| 4,221,490 | 9/1980 | Malm . | |
| 4,551,034 | 11/1985 | Zepell . | |
| 4,551,035 | 11/1985 | Baker et al. . | |
| 4,608,733 | 9/1986 | Eylers . | |
| 4,653,154 | 3/1987 | Malm . | |
| 4,765,767 | 8/1988 | Marynissen et al. . | |
| 4,786,197 | 11/1988 | Koeln et al. . | |
| 4,790,678 | 12/1988 | Araki . | |
| 4,837,900 | 6/1989 | Boyce et al. . | |
| 4,917,519 | 4/1990 | White et al. . | |
| 4,926,525 | 5/1990 | Eylers . | |
| 4,973,179 | 11/1990 | Nakazato et al. . | |
| 4,981,382 | 1/1991 | Murphy . | |
| 4,990,015 | 2/1991 | Perrin . | |
| 4,995,750 | 2/1991 | Akita . | |
| 5,074,694 | 12/1991 | Nakazato et al. . | |

FOREIGN PATENT DOCUMENTS

| | | | |
|---|---|---|---|
| 962297 | 6/1950 | France . | |
| 1175101 | 3/1959 | France | 24/11 D |
| 1303561 | 8/1962 | France . | |
| 1351513 | 12/1963 | France . | |
| 934749 | 11/1955 | Germany | 24/11 P |
| 1561799 | 4/1970 | Germany . | |
| 625986 | 1/1987 | Japan . | |
| 687004 | 2/1953 | United Kingdom . | |

*Primary Examiner*—Steven A. Bratlie
*Attorney, Agent, or Firm*—Peter G. Dilworth; Rocco S. Barrese; Joseph J. Catanzaro

[57] ABSTRACT

A writing instrument is provided which includes a body having a barrel portion and a plunger portion. The barrel portion has opposed front and rear ends for housing a replaceable writing cartridge and a spring for biasing the cartridge toward the rear end of the barrel portion. The plunger portion is removably maintained in the rear end of the barrel portion and is configured for moving the cartridge between a retracted portion and a protracted position and for rotational and axial movement with respect to the center line of the barrel portion for removing the plunger portion to replace the cartridge. A clip member is pivotably mounted to the body of the writing instrument and includes a latch for selectively engaging the body of the writing instrument when the cartridge is in a protracted position.

1 Claim, 9 Drawing Sheets

9A
10

FIG. 11
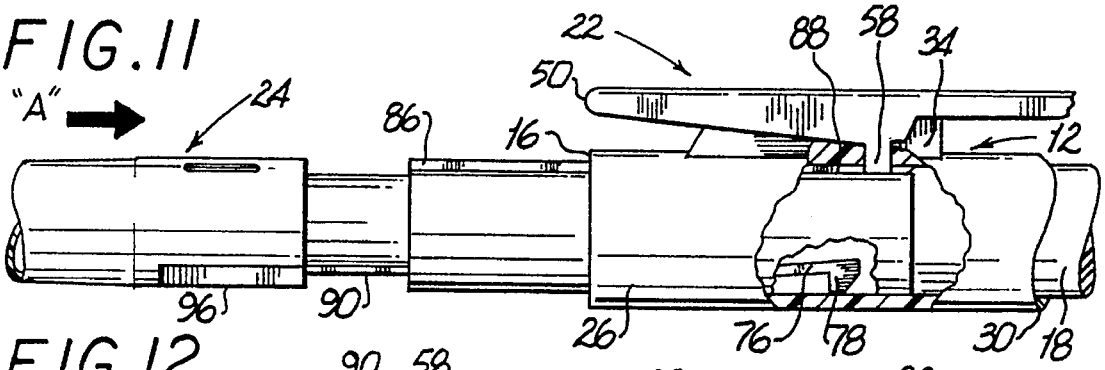
FIG. 12
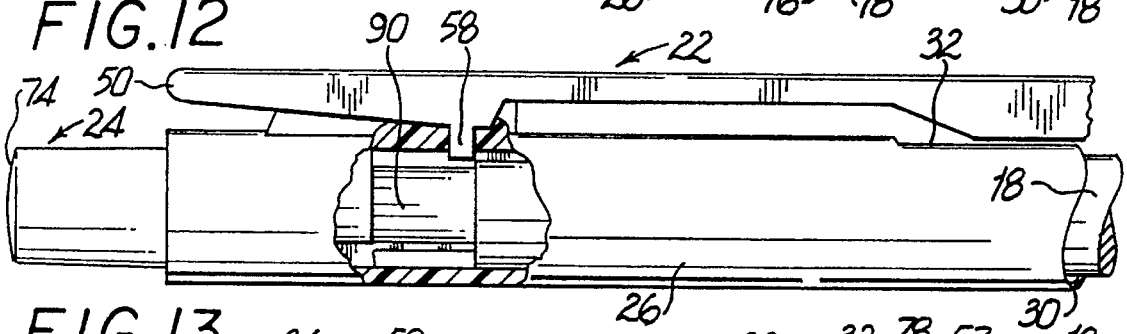
FIG. 13
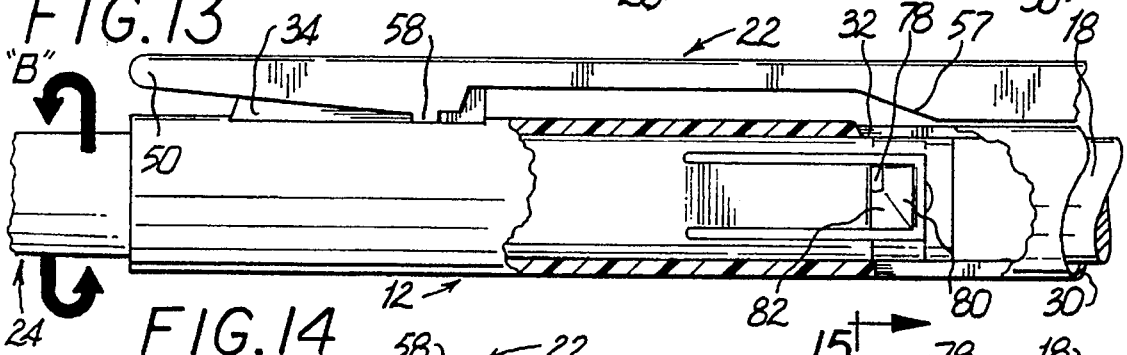
FIG. 14
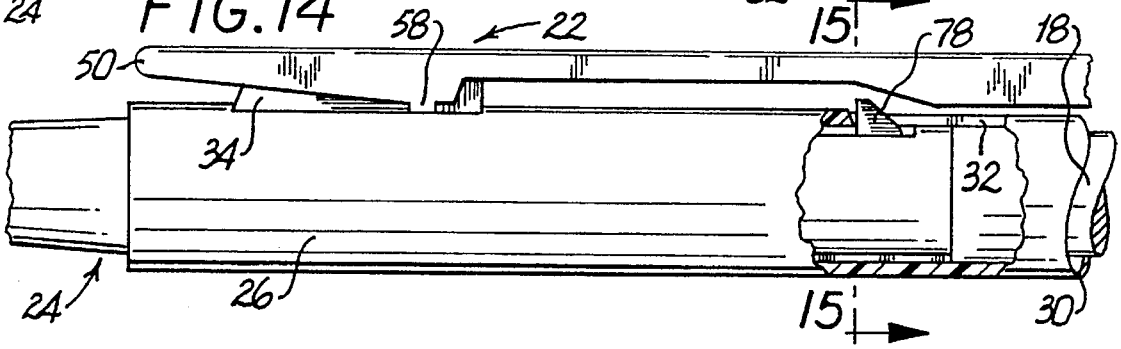
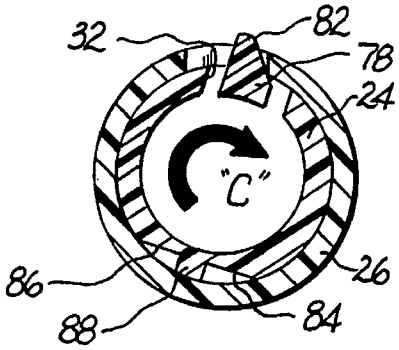
FIG. 15

"D"
"E"
"F"

"H"
"I"
"J"
"K"
100
102
104
106
108
109
110
112
114
115
116
118
120
122
128
130
132
150
152
160
164
168

RETRACTABLE WRITING INSTRUMENT HAVING REPLACEABLE CARTRIDGE

This is a continuation of application Ser. No. 07/959,166 filed Oct. 9, 1992 now U.S. Pat. No. 5,336,006.

BACKGROUND OF THE INVENTION

1. Field of the Invention

This invention is related to writing instruments, and more particularly to a writing instrument having a unique retractor mechanism which provides for greater convenience and ease in use and greater efficiency in manufacturing than known retractor mechanisms.

2. Discussion of Related Art

Writing instruments having a retracting cartridge element disposed in an elongated barrel are well known in the art. Examples of such writing instruments include: U.S. Pat. No. 4,981,382; U.S. Pat. No. 4,837,900; U.S. Pat. No. 3,326,189; U.S. Pat. No. 3,216,398; U.S. Pat. No. 3,092,080; and U.S. Pat. No. 3,033,167. Many of these prior art retractable writing instruments, however, have retractor mechanisms which comprise a plurality of interrelated mechanical elements, each of which must be disassembled in order to replace a spent writing cartridge. Moreover, the complex design of many of these retractor mechanisms makes recharging a difficult task which can require great dexterity and which can take a considerable amount of time. In addition, the plurality of mechanical elements, many of which are relatively small in comparison to the size of the pen body, can become misplaced upon disassembling the writing instrument. Consequently, if an element is lost, the writing instrument would become inoperative and thus would have to be discarded.

It is desirable therefore, to provide a retractable writing instrument having a single removable element which can be easily disassembled so that a spent writing cartridge can be quickly replaced.

SUMMARY OF THE INVENTION

The writing instrument of the subject invention essentially comprises a body having an elongated barrel portion and plunger means. The barrel portion has opposed front and rear end portions for housing a replaceable cartridge with a spring, where the spring is provided for biasing the cartridge toward the rear end portion of the barrel portion. As discussed herein, for purposes of continuity, all references to the "front" end of the barrel or writing instrument itself relates to the end at which the writing tip is disposed, while the "rear" end relates to the end at which the plunger means disposed. The plunger means is removably maintained at least partially within the rear end portion of the barrel portion and is movable in an axial direction between a first position wherein the cartridge is retracted within the barrel portion and a second position wherein the cartridge is protracted from the front end portion of the barrel portion of the writing instrument. In addition, the plunger means is dimensioned and configured for rotatable and axial movement with respect to the longitudinal axis of the barrel portion for removing the plunger means to replace the cartridge. The writing instrument further includes clip means pivotably mounted to the body and having latch means for engaging the body of the writing instrument when the plunger means is in the second position.

In a first embodiment of the invention, the barrel portion is provided with a longitudinally extending slot disposed adjacent to the rear end portion thereof defining a slotted portion. The plunger means is generally cylindrically configured and has opposed front and rear ends and includes a cantilevered detent member arranged proximate the front end thereof. The cantilevered detent has a sloped front face for facilitating insertion of the plunger means into the barrel portion during assembly and at least one inwardly sloped lateral face for facilitating disengagement of the detent member from the longitudinally extending slot provided in the barrel portion during disassembly. More particularly, upon rotating the plunger means out of the assembled position, to replace a spent cartridge, the sloped lateral face of the detent member acts to reduce contact friction between the detent member and the longitudinal slot.

In this embodiment, the clip means is pivotably mounted to the barrel portion of the body of the writing instrument. The clip means includes biasing means comprising leaf spring means which may be integrally formed with the clip means for biasing the latching end of the clip means towards the barrel portion. The clip means is also provided with a plurality of spaced apart tangs which can extend downward, perpendicular to the clip means, so as to be engaged within the wall of the barrel portion to attach the clip means to the barrel portion. Consequently, the tangs extend into the axial bore of the barrel portion. Therefore, to facilitate ease of assembly and disassembly of the writing instrument, the plunger means may be provided with a pair of spaced apart longitudinally extending tracks dimensioned and positioned for enabling an unobstructed insertion of the plunger means past the tangs of the clip means. Additionally, the plunger means may be provided with an annular slot extending partially about the circumference of the plunger and preferably through an arc of from about 150° to about 240°. The slot is dimensioned and positioned to enable an unobstructed rotation of the plunger means past the tangs of the clip means upon rotating the plunger means into a locked position during assembly and disassembly. Alternatively, the body of the plunger means may be dimensioned and configured for unobstructed insertion past the tangs of the clip means. Specifically, the cross-section dimensions of the plunger body would be sufficient to accommodate unobstructed insertion into the barrel position while maintaining a closely interfit relationship between the plunger means and the barrel portion.

In a second embodiment of the invention, the barrel portion of the writing instrument houses the cartridge and its associated biasing means. The elongated clip means includes means for biasing the latching end thereof toward the barrel portion, and is pivotably mounted to the plunger means, and includes a keeper notch disposed intermediate the opposed first and second ends thereof. A tab extends radially outward from the barrel portion proximate to the rear end thereof. In addition, a detent member extends radially outward from the barrel portion and is spaced forward of the tab. Preferably, the detent member and the tab are aligned collinearly with one another parallel to the longitudinal axis of the elongated barrel portion. In this embodiment, the latch means on the clip means is disposed in such a manner so as to engage the detent on the barrel portion when the plunger means is in the second position. Furthermore, the tab which is proximate to the rear end portion of the barrel portion is disposed in such a manner so as to be engaged in the keeper notch formed in the clip means when the plunger means is rotated into an assembled position.

BRIEF DESCRIPTION OF THE DRAWINGS

Further features of the invention will become more apparent from the accompanying drawings and the following detailed description of the subject invention.

Preferred embodiments of the subject invention will be described hereinbelow with reference to the drawings wherein:

FIGS. 11–14 illustrate a side plan view, in partial cross-section, of the writing instrument detailing a sequence of steps for assembling the writing instrument of FIG. 1;

FIG. 15 is a front cross-sectional view taken along line 15—15 of FIG. 14, in which the plunger is rotated to disassemble the writing instrument;

DETAILED DESCRIPTION OF PREFERRED EMBODIMENTS

Figure 1:
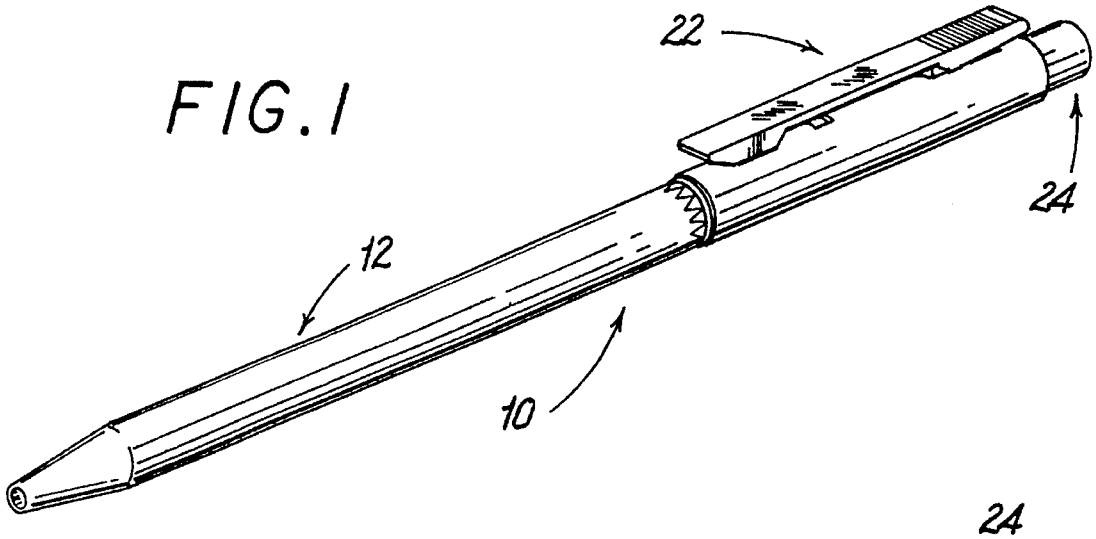
FIG. 1 is a perspective view of a writing instrument in accordance with a preferred embodiment of the subject invention.
Figure 2:
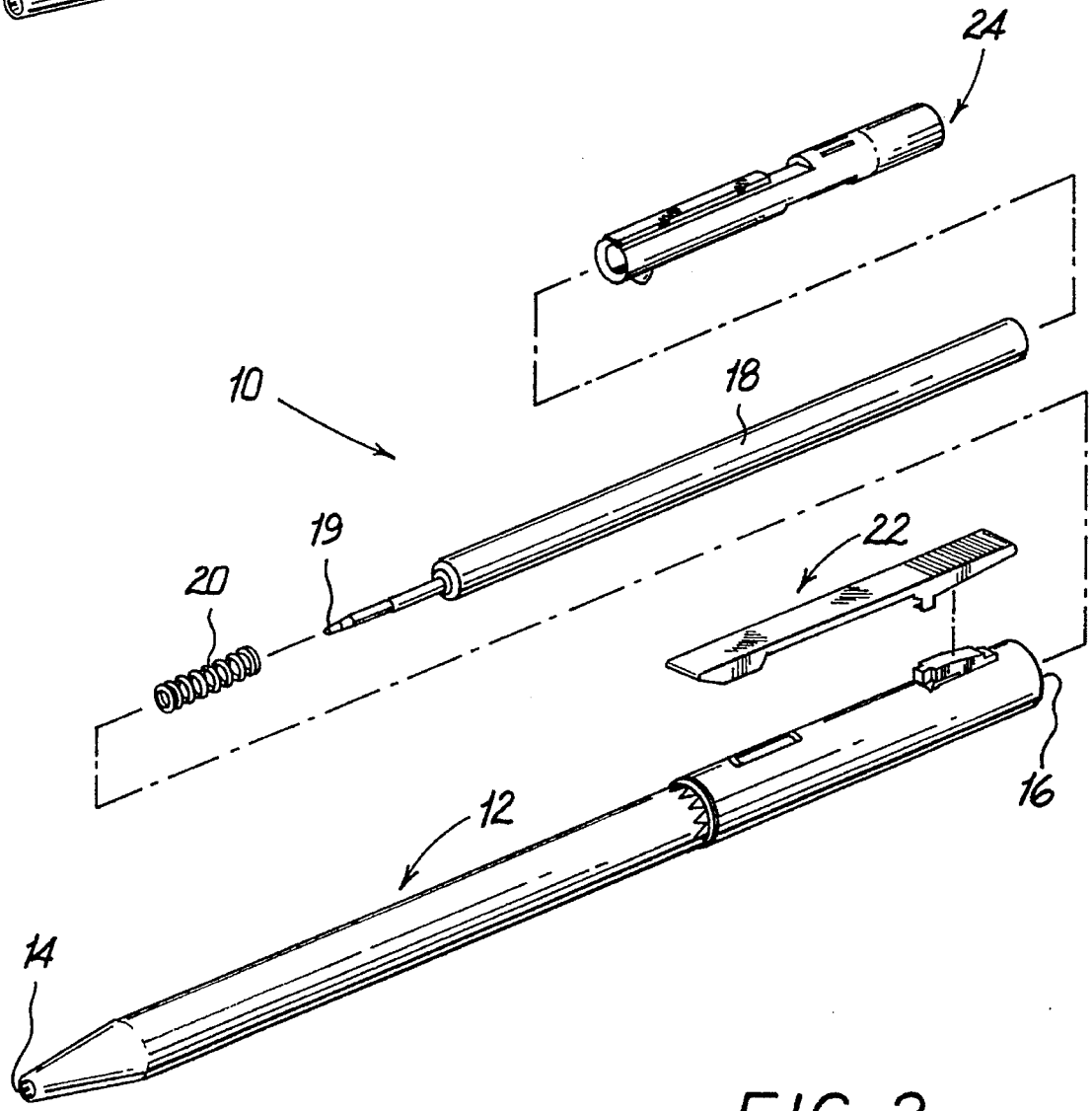
FIG. 2 is an exploded view of the component parts of the writing instrument of FIG. 1.

Referring now in detail to the drawings, in which like reference numerals identify similar or identical elements, a preferred embodiment of the writing instrument of the subject invention is illustrated in FIGS. 1 and 2 and is designated generally by reference numeral 10. Writing instrument 10 comprises an elongated barrel portion 12 having opposed front and rear ends 14 and 16, whereby the front end denotes the writing end and the rear end denotes the plunger mechanism end. A replaceable cartridge member 18 is disposed in the elongated barrel portion 12 and is biased toward the rear end 16 by a coiled spring 20 disposed in the front end 14 of the barrel portion 12. A clip member 22 is pivotably mounted to the barrel portion 12 adjacent to the rear end 16 thereof. Writing instrument 10 further comprises a plunger member 24 which is removably maintained in the rear end 16 of barrel portion 12 and which is adapted to be axially insertable and then rotated into an assembled and locked position. Once in the assembled position, the plunger 24 is movable in an axial direction within barrel portion 12 to protract and retract the writing tip of the cartridge 18 as described hereinbelow.

Figure 3:
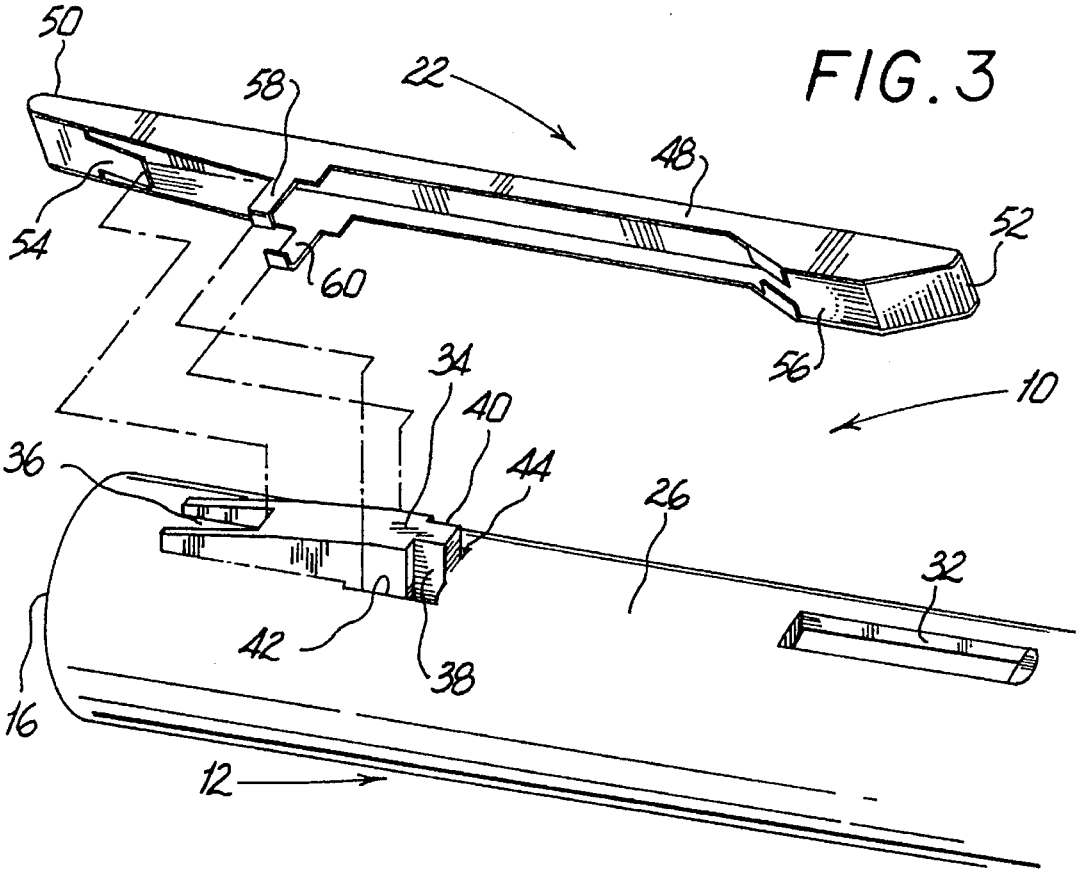
FIG. 3 is an enlarged exploded view of the rear end of the barrel of the writing instrument of FIG. 1.
Figure 4:
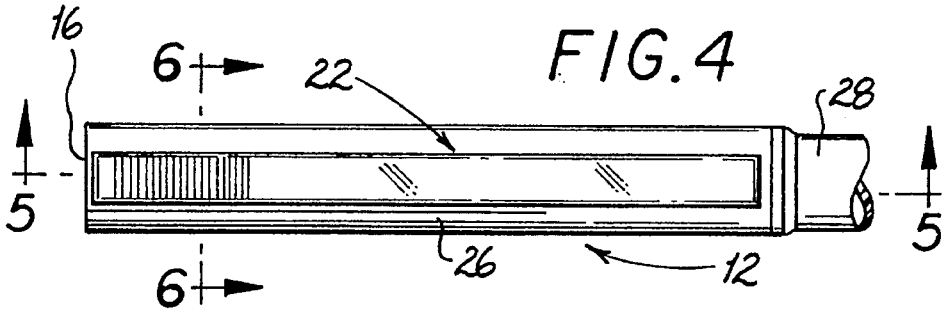
FIG. 4 is a top plan view of a rear end portion of the writing instrument of FIG. 1.
Figure 5:
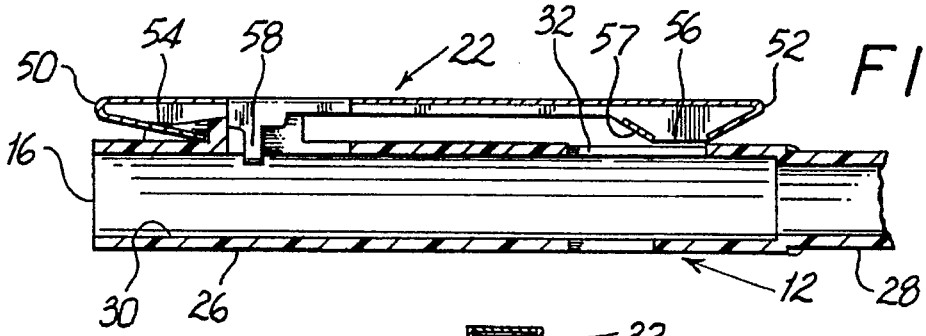
FIG. 5 is a side cross-sectional view taken along line 5—5 in FIG. 4.
Figure 6:
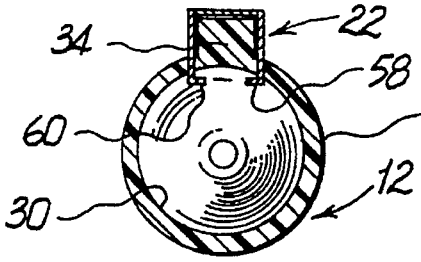
FIG. 6 is a rear end cross-sectional view taken along line 6—6 of FIG. 4.

Referring to FIG. 3, the barrel portion 12 of writing instrument 10 comprises a rear section 26 and a front section 28, with the front section 28 having a radius that is slightly less than that of the rear portion 26, although each section may have the same shape and dimensions. An axial bore 30 extends through barrel portion 12 from the rear end 16 thereof to the front end 14 thereof. Front end 14 of barrel portion 12 is tapered. Accordingly axial bore 30 is likewise tapered toward the front end 14. The rear section 26 of barrel portion 12 is formed with a longitudinally extending slot 32, and a clip mounting block 34 which are disposed collinear with one another. Mounting block 34 includes a rear port 36, and opposed lateral grooves 38 and 40. Lateral slots 42 and 44 are disposed adjacent to lateral grooves 38 and 40, respectively.

Figures 16, 17, 18, 19:
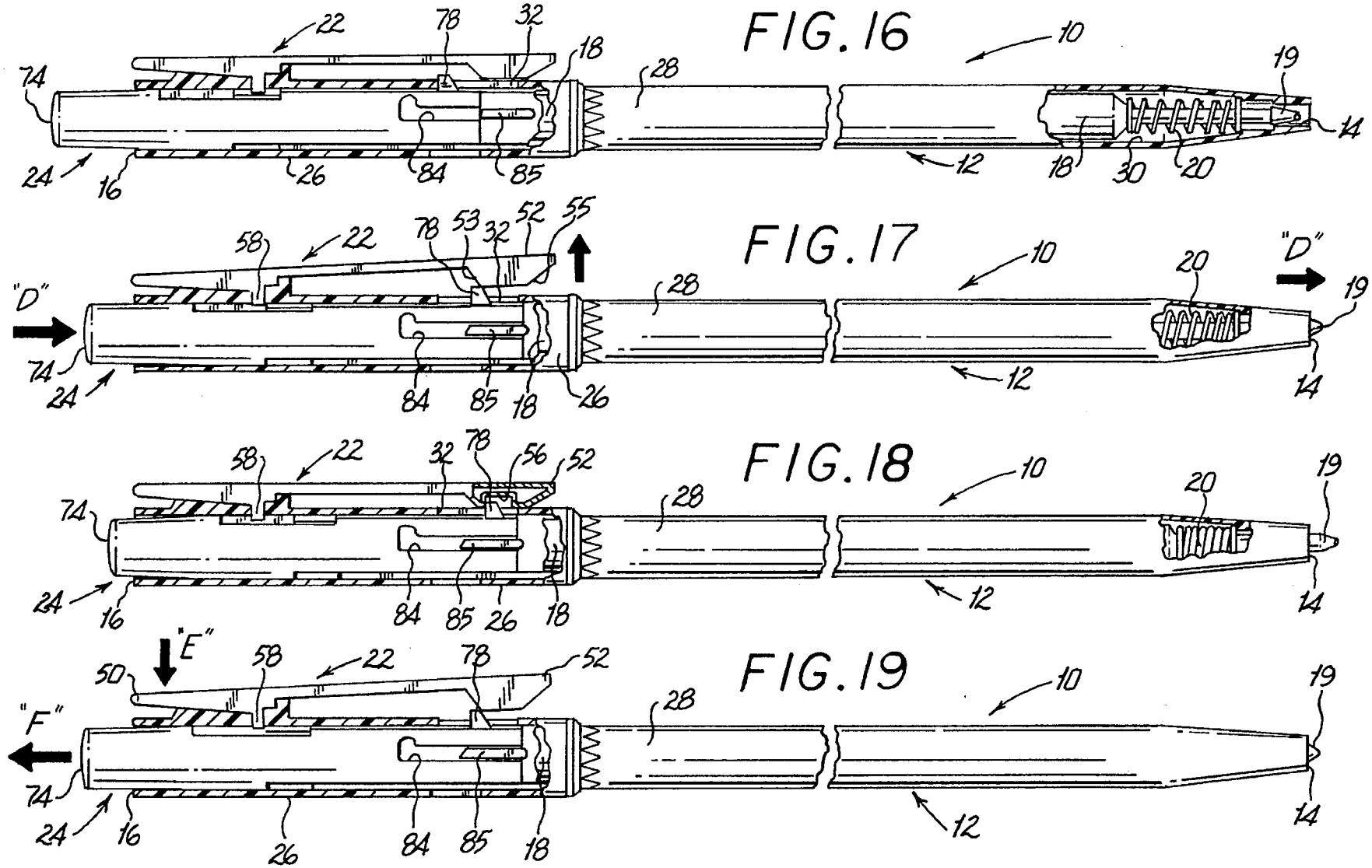
FIG. 16 is a side elevational view in partial cut-away, of the writing instrument of FIG. 1, with the cartridge in a retracted position.
FIG. 17 is a side elevational view in partial cut-away, of the writing instrument of FIG. 16, with the cartridge in a partially protracted position.
FIG. 18 is a side elevational view in partial cut-away, of the writing instrument of FIG. 16, with the cartridge in a fully protracted position.
FIG. 19 is a side elevational view in partial cut-away, of the writing instrument of FIG. 16, with the cartridge being retracted into the barrel.

Clip member 22, one example of which is shown in FIG. 3 and another example of which is shown in FIG. 18, includes a body section 48 having engagement end 50 and latching end 52. A leaf spring 54 is formed integral with the clip body 48 adjacent the engagement end 50 thereof, and a latch portion 56 having a sloped rear wall 57 is formed in the clip body 48 adjacent the latching end 52. A pair of L-shaped tangs 58 and 60 extend downwardly from the clip body 48 intermediate the ends 50 and 52 thereof for engagement in lateral slots 42 and 44 associated with mounting block 34.

Alternatively, clip 22 may include a leaf spring member which comprises an inner structure and which terminates within clip 22. An outer shell member may cover this leaf spring and include tangs 58 and 60, as well as latch portion 56.

Referring to FIGS. 3–6, clip 22 is assembled to the mounting block 34 on the barrel portion 12 by directing the L-shaped tangs 58 and 60 into the respective lateral grooves 38 and 40. Thereafter, clip 22 is urged rearward such that the L-shaped tangs 58 and 60 become engaged in the lateral slots 42 and 44. As clip 22 is urged rearward, leaf spring 54 rides along mounting block 34, which preferably has a rearwardly directed taper as shown. When tangs 58 and 60 reach the rear end of slots 42 and 44, the leaf spring 54 is positioned in the rear port 36 of mounting block 34, and once therein, is operable to bias latching end 52 of clip 22 in a radial direction toward barrel portion 12 of the writing instrument 10. More particularly, once assembled, the leaf spring 54 is positioned in a neutral condition preparatory to the operation of the writing instrument 10 in which leaf spring 54 depends angularly away from the body section 48 of clip member 22. However, during use, when the rear end 50 of clip 22 is depressed, the leaf spring 54 is deflected into a biasing position until the depression force is terminated. At such a time, the leaf spring 54 returns to a neutral condition, thereby forcing the front end 52 of clip 22 toward the barrel portion 12 of writing instrument 10.

Figures 7, 8, 8A, 9, 9A, 10:
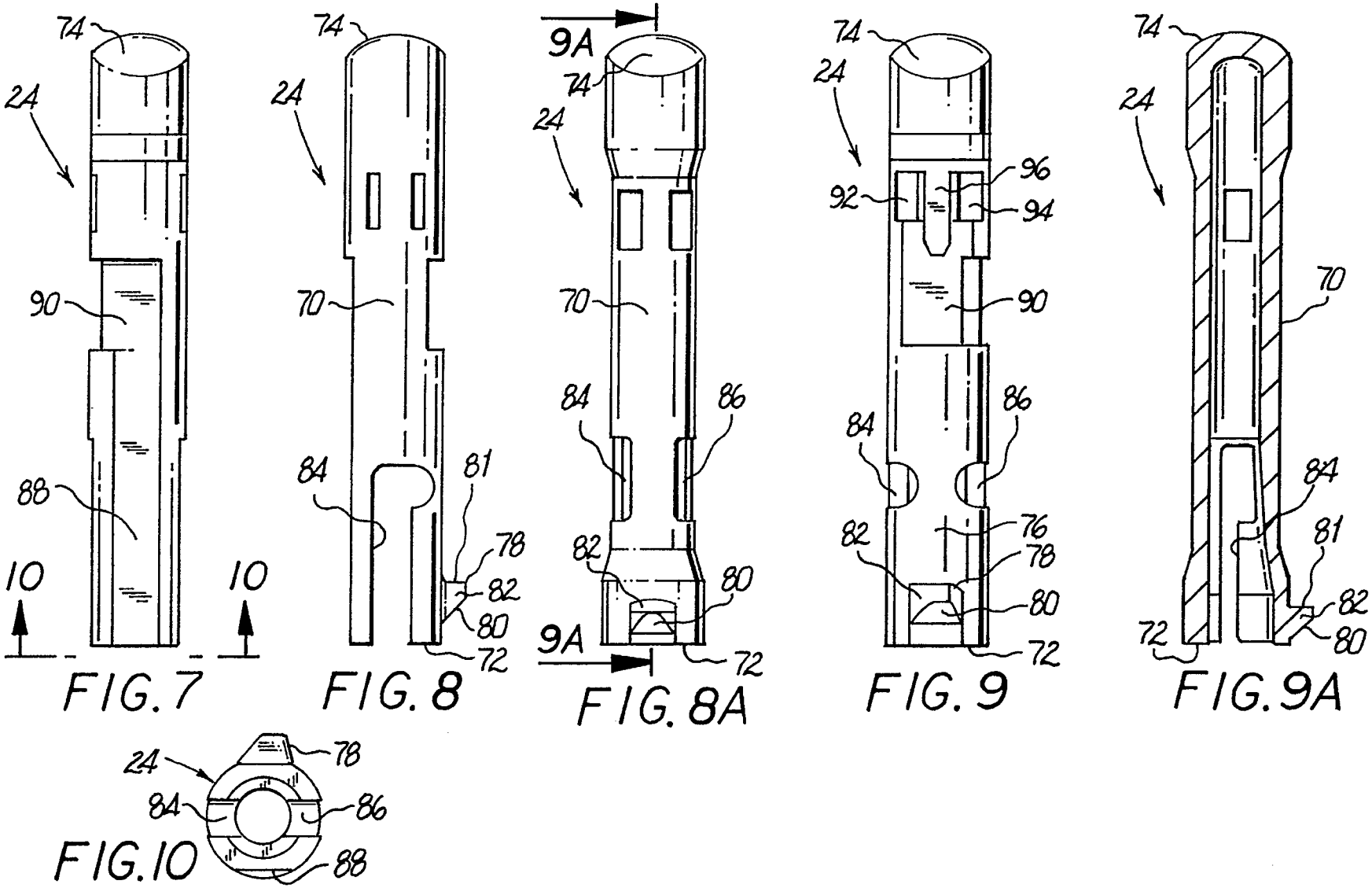
FIGS. 7–9 are plan views of the plunger member of the writing instrument of the FIG. 1.
FIGS. 8A and 9A are plan views of another embodiment of the plunger member of the writing instrument of FIG. 1.
FIG. 10 is a front elevational view of the plunger member taken along line 10—10 of FIG. 7.

Turning to FIGS. 7–10, the plunger member 24 of writing instrument 10 comprises an elongated substantially cylindrical body 70 having an actuation end 74 and a cartridge end 72, with the cartridge end 72 being opened and the actuation end 74 being closed to form a push button to be operated by the thumb of a user. The plunger body 70 is formed with an integral cantilevered beam 76 disposed adjacent to end 72. A ramped detent 78 is integrally formed on the free end of the cantilevered beam 76 and includes a sloped face 80 and an inwardly sloped lateral face 82 to form a generally wedged-shaped surface, which is best seen in FIG. 9. Detent 78 is releasably engagable in the elongated slot 32 formed in barrel portion 12, and is also operable to releasably engage the latch portion 56 formed in the latching end 52 of clip member 22.

The cantilevered beam 76 is defined by a pair of diametrically opposed generally L-shaped grooves 84 and 86 which extend longitudinally from the cartridge end 72 of plunger body 70. Grooves 84 and 86 cooperatively engage corresponding diametrically opposed ribs 85 which extend radially inward from the wall of barrel portion 12 adjacent the rear end 16 thereof, when plunger 24 is moved from a retracted position to a protracted position. In a protracted position, cantilevered beam 76 of plunger body 70 is advantageously supported by internal ribs 85 so as to properly maintain detent 78 in engagement with the latch portion 56 of clip member 22. The function of detent 78 will be discussed later in greater detail.

Plunger body 70 is also formed with a planar track 88 which extends longitudinally from the cartridge end 72 and which terminates at a location intermediate the plunger body 70, where a circumferential groove 90 is formed. Groove 90 extends through an arc of between 150° and 240°. A pair of spaced apart tracks 92 and 94 extend rearwardly from the circumferential groove 90 to a location adjacent the actuation end 74 of the plunger 24. A guide rail 96 is formed between tracks surfaces 92 and 94 and is preferably diametrically opposed to planar track 88.

Track 88 functions to allow unobstructed insertion of the plunger body 70 into the rear end 16 of the barrel portion 12 upon assembling writing instrument 10. More particularly, track 88 permits the plunger 24 to pass by the tangs 58 and 60 which extend through slots 42 and 44 respectively. Similarly, the circumferential groove 90 functions to permit unobstructed rotation of the plunger body 70 through a desired arc during the assembly of writing instrument 10.

Referring to FIGS. 8A and 9A, another embodiment of plunger portion 24 is illustrated, the body of which is particularly dimensioned and configured for unobstructed insertion into the rear end 16 of barrel portion 12 upon assembling writing instrument 10. Specifically, the cartridge end 72 of plunger portion 24 has a cross-sectional diameter which enables the plunger 24 to pass by the tangs 58 and 60 of clip member 22 during assembly, while maintaining a closely interfit relationship with the barrel portion 12 once the writing instrument 10 is assembled. In addition, the plunger body 70 has a reduced diameter intermediate the actuation end 74 and the cartridge end 72 thereof, for facilitating the rotational disassembly of the plunger portion 24 from the barrel portion 12 of writing instrument 10 to replace the writing cartridge 18.

Referring to FIGS. 7–10 and 11–14, to assemble the writing instrument 10, initially, the plunger portion 24 is inserted into the rear end 16 of barrel portion 12 in the direction of arrow "A" in FIG. 11. Plunger portion 24 is aligned during insertion so that track 88 is positioned proximate to the spaced apart tangs 58 and 60 of clip 22. At this time, the cantilevered beam 76 is flexed radially inward so that the detent 78 may ride into the axial bore 30. Moreover, ramped surface 80 aids in the smooth passage of plunger portion 24 into barrel portion 12. Once the plunger portion 24 has been fully inserted into the barrel portion 12 as illustrated in FIG. 12, the plunger 24 is rotated in the direction of arrow "B" into a locked position. At this time, the tangs 58 and 60 are positioned in the circumferential flange 90 formed in the plunger body 70 to allow the plunger portion 24 to be rotated through an arc of approximately 180° degrees until the detent 78 has become engaged in the longitudinally extending slot 32 which is formed in the rear section 26 of barrel portion 12, as shown in FIG. 14.

Turning now to FIG. 16 the writing instrument 10 is illustrated in a position wherein the writing tip 19 of cartridge 18 is fully retracted within the front end 14 barrel portion 12. When the writing cartridge 18 is in this position, the coiled spring 20 is in a relaxed condition and plunger portion 24 is extended out of the rear end of barrel portion 12.

Referring to FIG. 17, in using writing instrument 10, writing cartridge 18 is moved from a retracted position to a protracted position by pressing the rear end 74 of plunger portion 24 in the direction of arrow "D". During this forward axial movement, the coiled spring 20 becomes gradually depressed in the front end 14 of barrel portion 12. Simultaneously, the ramped rear wall 57 of latch 56 slides upwardly along the forward face 80 of detent 78 as clip 22 is caused to pivot about tangs 58 and 60.

Plunger portion 24 continues to advance until detent 78 is engaged in latch 56, as shown in FIG. 18. Thereupon, the latching end 52 of clip 22 is pivoted back toward the barrel portion 12 under the influence of leaf spring 54. At this time, internal ribs 85 are engaged in grooves 84 and 86 so as to maintain cantilevered detent 78 in engagement with latch 56. Thereupon, the coiled spring 20 is fully compressed and the writing tip 19 of writing cartridge 18 is fully protracted out of the front end 14 of barrel portion 12. In this position, the instrument 10 may be used for writing.

Referring to FIG. 19., to retract cartridge 18 into barrel portion 12, end 50 of clip 22 is depressed in the direction of arrow "E" so as to pivot clip 22 about tangs 58 and 60. As clip 22 is pivoted, latching end 52 moves away from the barrel portion 12 until the detent 78 is disengaged from latch 56. Thereupon, spring 20 decompresses, forcing the writing cartridge 18 rearward, and concurrently causing plunger 24 to advance out of the rear end 16 of barrel portion 12. Plunger portion 24 continues to advance until the rear wall 81 of detent 78 comes into contact with the rearward edge of slot 32. Alternatively, the detent 78 may be disengaged from the latch 56 of clip 22 by placing the writing instrument 10 into a shirt pocket to automatically retract cartridge 18.

To remove and replace the cartridge 18, plunger 24 is rotated in the direction of arrow "C" as best seen in FIG. 15. Upon rotating plunger portion 24, the sloped lateral face 82 of detent 78 functions to ease the disengagement of detent 78 from the longitudinally extending slot 32 formed in the rear section 26 of the barrel portion 12.

Figure 20:
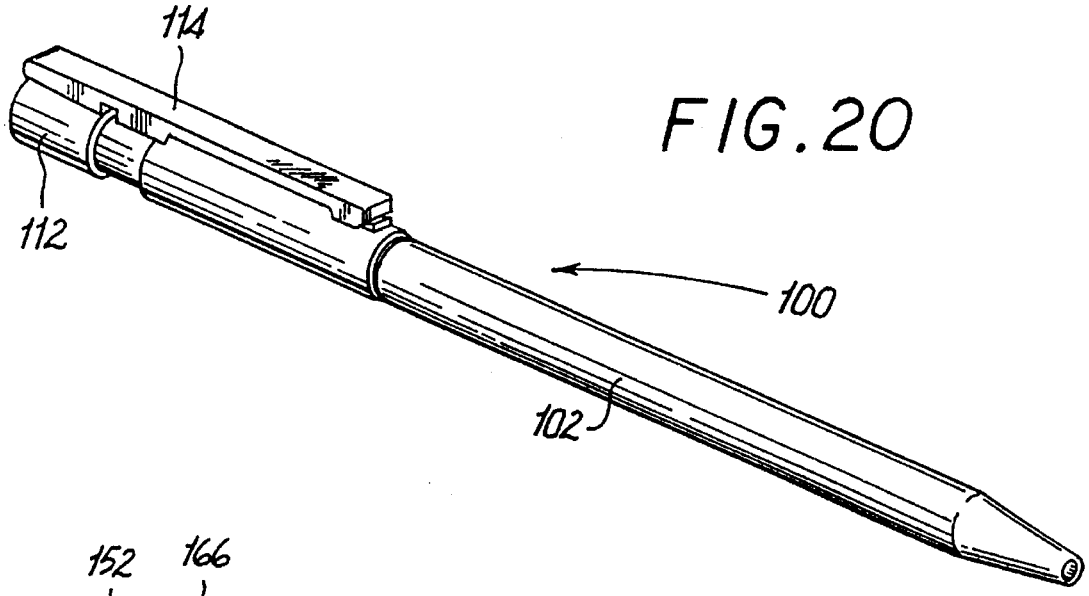
FIG. 20 is a perspective view of an alternate embodiment of the writing instrument of the subject invention.
Figure 21:
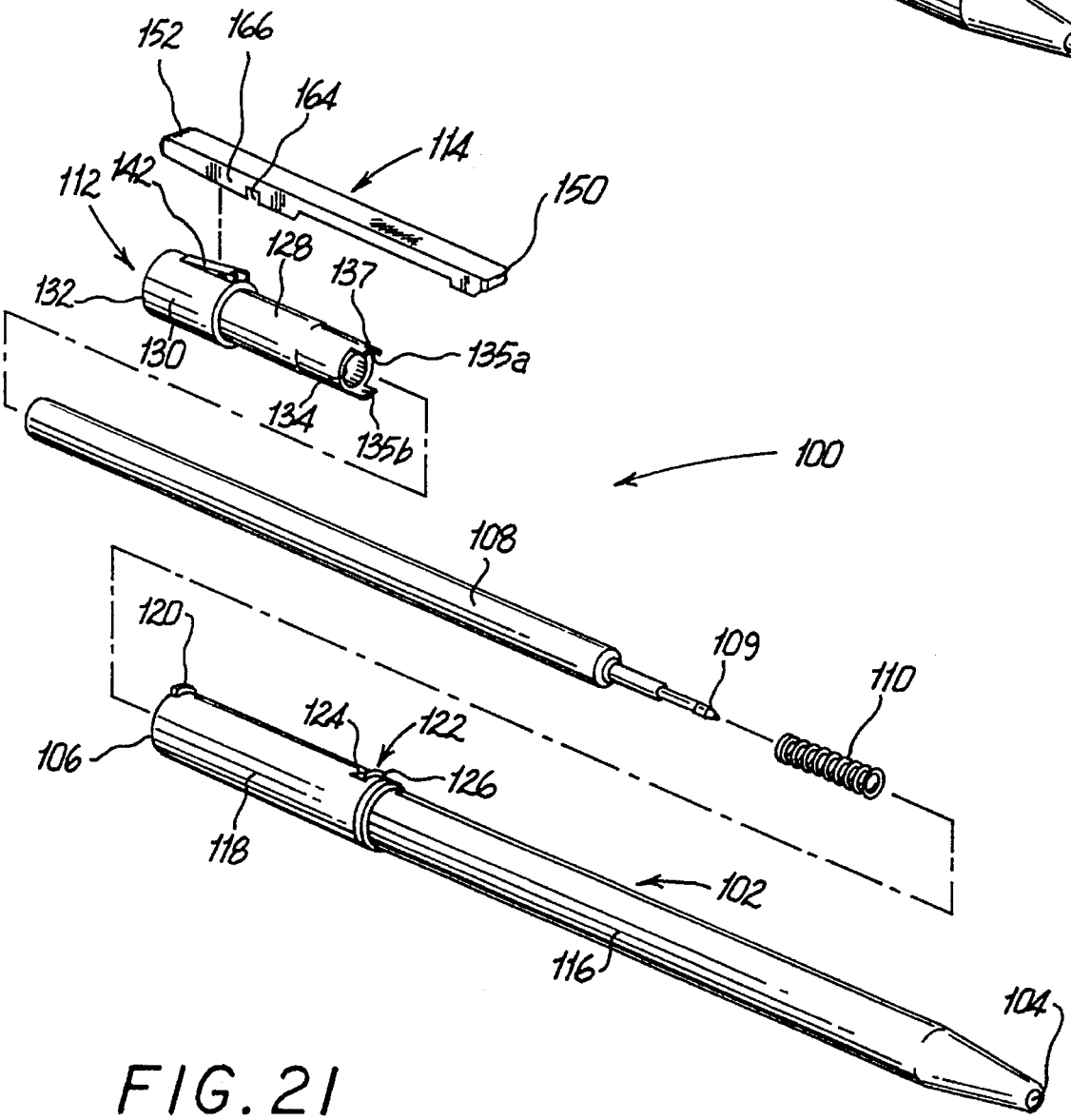
FIG. 21 is an exploded view of the component parts of the alternate embodiment of the writing instrument of FIG. 20.

Turning now to FIGS. 20 and 21, an alternate writing instrument 100 is illustrated. Writing instrument 100 comprises an elongated barrel portion 102 having opposed front and rear ends 104 and 106. A replaceable cartridge member 108 having a writing tip 109 is disposed in the barrel portion 102 and is biased toward the rear end 106 thereof by a coiled spring 110. Writing instrument 100 further comprises a plunger portion 112 which is removably maintained in the rear end 106 of barrel portion 102.

The barrel portion 102 of writing instrument 100 includes a front section 116 which tapers as shown, to a writing tip, and a rear section 118 which includes the retractor mechanism. The rear section 118 of barrel portion 102 is formed with a radially outward extending tab 120 disposed proximate to the rear end 106 thereof, which cooperates with the clip 114 on plunger portion 112 as will be described hereinbelow. In addition, a radially outward extending detent 122 is provided and is spaced from the rear end 106, which also is cooperative with the clip 114 in a manner described below. Detent 122 has a top surface 124, which is ramped rearwardly, and a front surface 126, which is substantially orthogonal to the axis of the barrel portion 102. Tab 120 and detent 122 are disposed collinear with one another, along the longitudinal axis of barrel portion 102.

The plunger portion 112 of the writing instrument 1130 includes a cartridge end 128 and an actuation end 130. Actuation end 130 has a closed face 132 which functions as a push button for being depressed by a user. The cartridge end 128 has an open end 134, into which the writing cartridge 108 may be received or may abut against when the writing instrument 100 is assembled. A pair of diametrically opposed tabs **135*a* and 135*b* extend forwardly from the open end 134 of plunger portion 112 each having a detent 137 formed thereon for guiding the axial translation of the plunger portion 112 within the barrel portion 102. A mounting block 142 having a tapered surface 144 is formed on the actuation end 130 of plunger portion 112, onto which the clip 114** is pivotably mounted.

Figure 22:
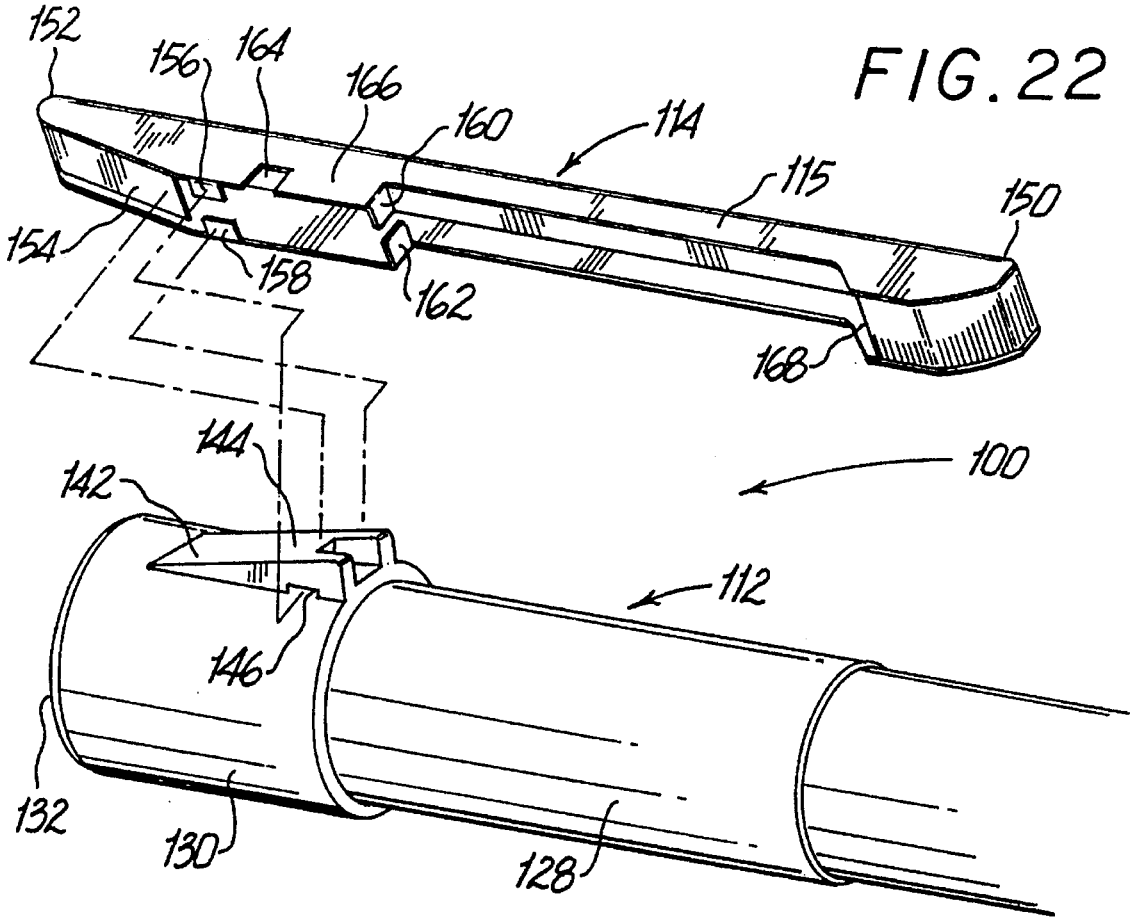
FIG. 22 is an enlarged exploded view of the rear end of the plunger of the writing instrument of FIG. 20.

Referring to FIG. 22, mounting block 142 includes a rearwardly sloped top surface 144 and opposed lateral mounting slots 146 and 148. Clip 114 has a shell 115 with engagement end 152 and latch end 150. A leaf spring 154 is positioned within shell 115 and extends from the engagement end 152 of clip 114. Alternatively, clip 114 may be of unitary construction such that leaf spring 154 and shell 115 are of integral structure. Leaf spring 154 pushes against the ramped top surface 144 of mounting block 142 to bias the latch end 150 of clip 114 toward the plunger portion 112 of writing instrument 100. Clip 114 also includes a pair of opposed integrally formed tangs 156 and 158 which are disposed adjacent to leaf spring 154 and which are pivotably engagable in the lateral slots 146 and 148 respectively, in mounting block 142. In addition, integral flanges 160 and 162 are provided on clip 114, and together define an intermediate wall which functions to limit the axial movement of plunger portion 112 with respect to barrel portion 102 when the writing instrument 100 is retracted.

Clip 114 is also provided with a rectangular port 164 which is formed in the side wall 166 of shell 115. Port 164 is provided for receiving the outwardly extending tab 120 that is formed on the rear end 106 of barrel portion 102. A front wall 168 is also formed on clip 114 adjacent to the latch end 150 thereof. Front wall 168 of clip 114 cooperates with the radially outward extending detent 122 that is formed on barrel portion 102.

Figure 23:
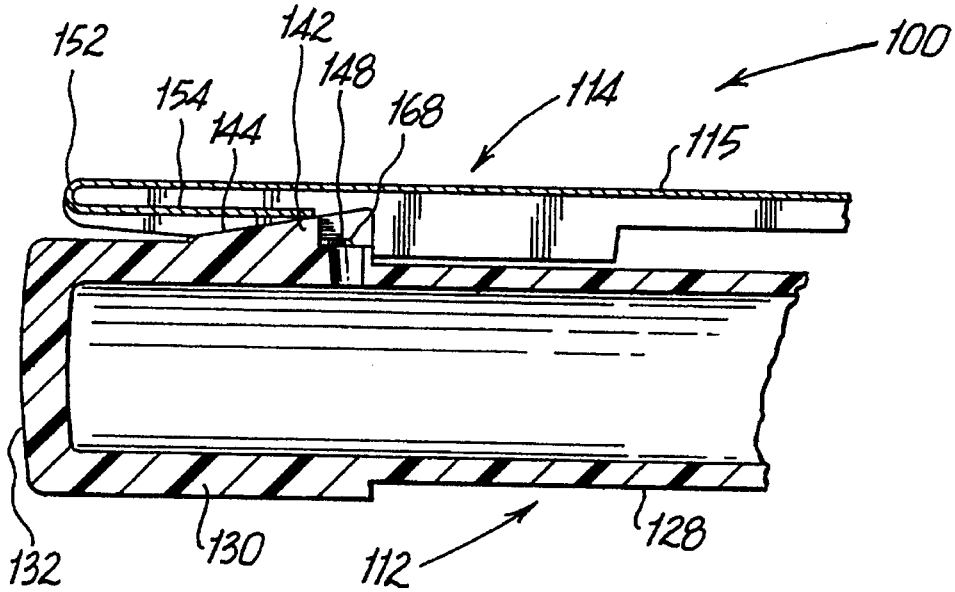
FIG. 23 is a side cross-sectional view of a portion of the plunger of the writing instrument of FIG. 20.

Referring to FIG. 23, clip 114 is pivotably mounted on mounting block 142 by engaging the opposed tangs 156 and 158 in opposed lateral slots 146 and 148 respectively. Once mounted, the leaf spring 154 of clip 114 is compressed against the rearwardly ramped surface 144 in such a manner so as to bias the latch end 150 of clip 114 toward the plunger portion 112 of writing instrument 100.

Figure 24:
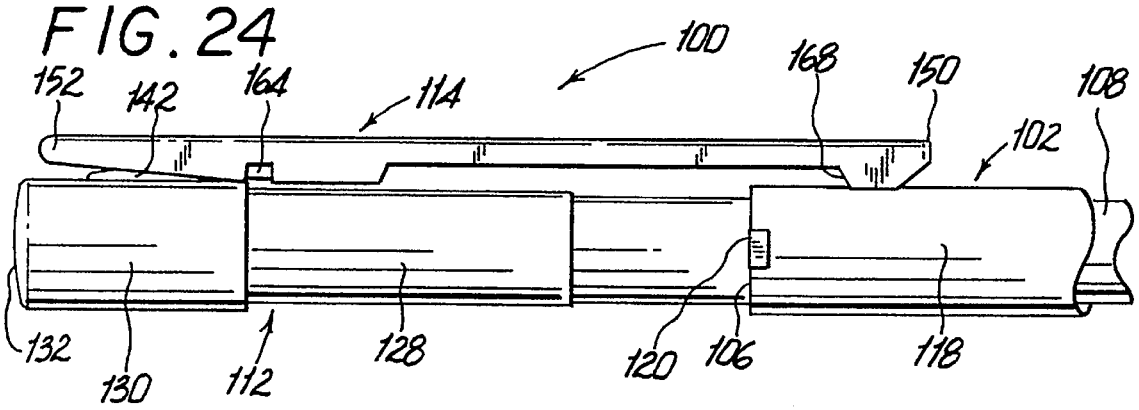
FIGS. 24–26 illustrate a side plan view of the rear end of the writing instrument detailing a sequence of steps for assembling the writing instrument illustrated in FIG. 20.
Figure 25:
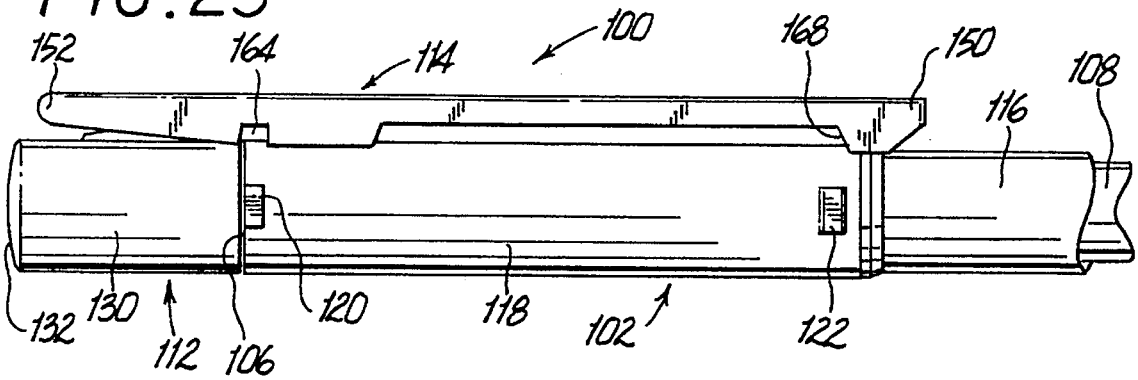
Figure 26:
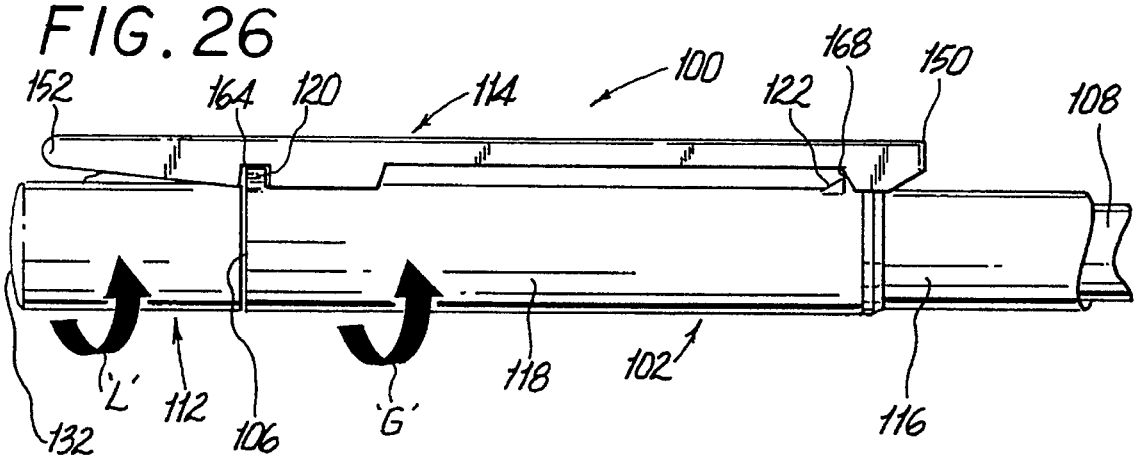

As seen in FIGS. 24–26, writing instrument 100 is assembled by initially inserting plunger portion 112 into the rear end 106 of barrel portion 102. As the plunger portion 112 is extended into barrel portion 102, the latch end 150 of the clip 114 rides up onto the rear section 118 of barrel portion 102, thereby compressing the leaf spring 154 against the ramped surface 144 of mounting block 142. Once the plunger portion 112 has been fully inserted into the rear end 106 of barrel portion 102, the rectangular port 164 in clip 114 is in position to receive the outwardly extending tab 120 of barrel portion 102. At this time, the barrel portion 102 may be rotated in the direction of arrow "G" with respect to the axial center line of barrel portion 102 until the tab 120 has become engaged in port 164. Simultaneously, the ramped detent 122 comes into an operative position behind the front wall 168 of clip 114.

Figures 27, 28, 29, 30:
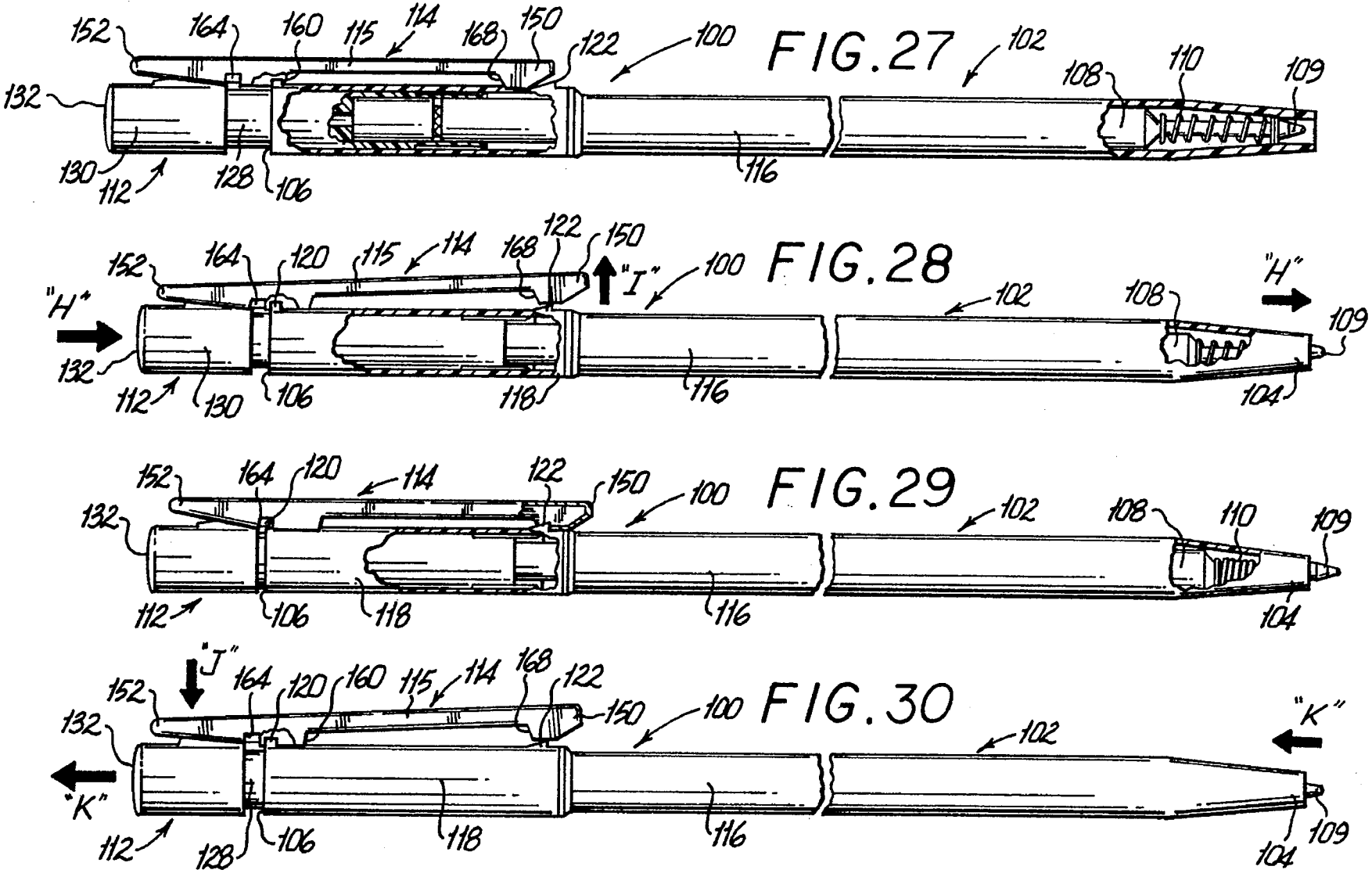
FIG. 27 is a side elevational view, in partial cut away, of the writing instrument of FIG. 20 with the writing cartridge in a retracted position.
FIG. 28 is a side elevational view in partial cut-away, of the writing instrument of FIG. 27, with the writing cartridge in a partially protracted position.
FIG. 29 is a side elevational view in partial cut-away of the writing instrument of FIG. 27, with the writing cartridge in a fully protracted writing position.
FIG. 30 is a side elevational view of writing instrument of FIG. 27, with the writing cartridge being retracted into the barrel portion.

Referring to FIGS. 27–30, in using writing instrument 100, cartridge 108 is moved from its retracted position of FIG. 27, to a protracted position by pressing the rear end 132 of plunger portion 112 in the direction of arrow "H", whereby latch end 150 rides over detent 122, causing clip 114 to pivot in the direction of arrow "I". Referring to FIG. 29, when the writing instrument 100 is in a fully protracted position the elongated clip 114 passes over detent 122 and is substantially parallel to the longitudinal axis of barrel portion 102.

To retract cartridge 108 into the front end 104 of barrel portion 102, the engagement end 152 of clip 114 is depressed in the direction of arrow "J" so as to cause the clip 114 to pivot away from the barrel portion 102, about tangs 156 and 158. This pivoting movement causes the latch end 150 to disengage from the detent 122, so that as coiled spring 110 decompresses, writing cartridge 108 moves rearwardly, and causing plunger portion 112 to advance out of the rear end 106 of barrel portion 102 in the direction of arrow "K". The plunger portion 112 will continue to advance out of the rear end 106 of barrel portion 102 until the intermediate wall formed by flanges 160 and 162 comes into contact with the outwardly extending tab 120 as shown in FIG. 27.

Alternatively, as in the preferred embodiment, the clip 114 may be disengaged from the detent 122 by placing the writing instrument 100 into a shirt pocket so that the pocket material forces the latch end 150 of clip 114 away from barrel portion 102 to disengage latch end 150 from the detent 120.

To disassemble the writing instrument 100, and remove the cartridge 108, plunger 112 is advanced into barrel 102 to the position shown in FIG. 29, and is then rotated in the direction of arrow "L" in FIG. 26 to remove tab 120 from port 164 as shown in FIG. 25. Plunger 112 may then be pulled rearwardly and removed from barrel 102 to access the cartridge 108.

The writing instrument of the subject invention is easy to use and extremely efficient to manufacture. The instrument enables a user to quickly and easily replace a spent writing cartridge with little dexterity involved. The subject invention overcomes many of the disadvantages encountered with prior writing instruments which have retractor mechanism comprising a plurality of interrelated mechanical elements.

While the invention has been shown and described with respect to a preferred embodiment, it will be understood by those skilled in the art that various modification and changes may be made therein without departing from the spirit and scope of the invention.

What is claimed is:

1. In a writing instrument of the type having a barrel, a plunger, and a writing element disposed within the barrel, the barrel having a mounting mechanism for a pocket clip, the mounting mechanism including a raised fulcrum and at least one pair of slots passing through the barrel, the improvement which comprises:

a pocket clip having a body portion, engaging means provided at a first end of said body portion for engaging the barrel of the writing instrument, unitary leaf spring means provided at a second end of said body portion for biasing said first end towards the barrel, and mounting means disposed intermediate said first and second ends which cooperates with the mounting mechanism of the barrel for pivotably mounting said pocket clip to the barrel, said mounting means including at least one pair of spaced apart tangs depending perpendicularly from said body portion and each including an inwardly extending flange portion;

wherein said tangs are received in the slots of said barrel to mount said pocket clip to the barrel.

* * * * *